US008346150B2

(12) United States Patent
Inoue et al.

(10) Patent No.: US 8,346,150 B2
(45) Date of Patent: Jan. 1, 2013

(54) FIXING DEVICE, IMAGE FORMING APPARATUS, AND IMAGE FORMING METHOD

(75) Inventors: Tomofumi Inoue, Toyonaka (JP); Shuuichi Nakagawa, Suita (JP); Hidekazu Shono, Takarazuka (JP)

(73) Assignee: Ricoh Company, Ltd., Tokyo (JP)

( * ) Notice: Subject to any disclaimer, the term of this patent is extended or adjusted under 35 U.S.C. 154(b) by 458 days.

(21) Appl. No.: 12/751,213

(22) Filed: Mar. 31, 2010

(65) Prior Publication Data

US 2010/0266304 A1 Oct. 21, 2010

(30) Foreign Application Priority Data

Apr. 21, 2009 (JP) ..... 2009-102852

(51) Int. Cl.
*G03G 15/20* (2006.01)
*G03G 11/00* (2006.01)

(52) U.S. Cl. ..... 399/342; 399/68; 399/322; 399/328

(58) Field of Classification Search ..... 399/67, 399/68, 320, 322, 328–333, 337, 341–343
See application file for complete search history.

(56) References Cited

U.S. PATENT DOCUMENTS

| | | | | |
|---|---|---|---|---|
| 2004/0042809 | A1* | 3/2004 | Fuma et al. | 399/67 |
| 2008/0056784 | A1* | 3/2008 | Nakamura et al. | 399/341 |
| 2008/0056785 | A1* | 3/2008 | Maruyama et al. | 399/342 |

FOREIGN PATENT DOCUMENTS

| | | |
|---|---|---|
| JP | 48-94438 | 12/1973 |
| JP | 4-31389 | 2/1992 |
| JP | 2511826 | 4/1996 |
| JP | 3200251 | 6/2001 |
| JP | 2008-20520 | 1/2008 |
| JP | 2008-51857 | 3/2008 |
| JP | 2008-64804 | 3/2008 |
| JP | 2008-65127 | 3/2008 |

* cited by examiner

*Primary Examiner* — Walter L Lindsay, Jr.
*Assistant Examiner* — Jessica L Eley
(74) *Attorney, Agent, or Firm* — Oblon, Spivak, McClelland, Maier & Neustadt, L.L.P.

(57) ABSTRACT

In a fixing device, an opposing member contacts a heating member to form a fixing nip between the heating member and the opposing member. A driver rotatively drives at least one of the heating member and the opposing member. A sheet supplier supplies and conveys a sheet to the fixing nip. A recording medium bearing an unfixed toner image is conveyed through a gap between the sheet and the opposing member at the fixing nip with a side of the recording medium bearing the unfixed toner image facing the sheet. At least one of the rotating heating member and the rotating opposing member applies a driving force to the sheet supplied to the fixing nip while the sheet contacts the sheet supplier to apply tension to the sheet at a position upstream from the fixing nip in a sheet conveyance direction.

16 Claims, 7 Drawing Sheets

FIXING DEVICE, IMAGE FORMING APPARATUS, AND IMAGE FORMING METHOD

CROSS-REFERENCE TO RELATED APPLICATIONS

The present application is based on and claims priority to Japanese Patent Application No. 2009-102852, filed on Apr. 21, 2009 in the Japan Patent Office, which is hereby incorporated herein by reference in its entirety.

BACKGROUND OF THE INVENTION

1. Field of the Invention

Exemplary aspects of the present invention relate to a fixing device, an image forming apparatus, and an image forming method, and more particularly, to a fixing device for fixing a toner image on a recording medium, an image forming apparatus including the fixing device, and an image forming method using the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

In such fixing device, a heating roller and a pressing roller pressed against each other apply heat and pressure to a recording medium bearing an unfixed toner image as the heating roller and the pressing roller nip and convey the recording medium. Thus, the heat and the pressure fix the toner image on the recording medium. Specifically, the heating roller contacts the unfixed toner image on the recording medium to melt the toner. Accordingly, the melted toner, which contains resin to facilitate melting, may adhere to the surface of the heating roller. When the resin in the toner adhered to the heating roller solidifies, the solidified resin may generate asperities on the surface of the heating roller. When the heating roller having the surface asperities contacts the unfixed toner image on the recording medium to fix the unfixed toner image, the surface asperities of the heating roller may generate asperities on the fixed toner image. As a result, the fixed toner image may not have gloss.

To address this problem, a gloss application sheet may be overlaid on the image side of the recording medium which bears the unfixed toner image, so that the heating roller applies heat to the unfixed toner image on the recording medium via the gloss application sheet.

FIGS. 1 and 2 illustrate a fixing device 6R using such gloss application sheet S. In the fixing device 6R, a sheet conveyance roller 300 feeds a gloss application sheet S sent from a sheet container to a fixing nip N between a heating roller 100 and a pressing roller 200. Immediately thereafter, a recording sheet P bearing an unfixed toner image T enters the fixing nip N. Thus, while the rotating heating roller 100 and the rotating pressing roller 200 nip and convey the gloss application sheet S overlaid on the recording sheet P, heat is transmitted from the heating roller 100 to the unfixed toner image T on the recording sheet P via the gloss application sheet S to melt and fix the toner image T on the recording sheet P. Thereafter, the gloss application sheet S is separated from the recording sheet P to form a smooth, glossy toner image on the recording sheet P.

However, the fixing device 6R using the gloss application sheet S has a drawback in that, when the gloss application sheet S reaches the fixing nip N, the inherent rigidity of the gloss application sheet S may cause the gloss application sheet S to separate from the surface of the heating roller 100 near the entry to the fixing nip N, that is, at an area indicated by arrow Z in FIG. 2. As the recording sheet P moves through the position indicated by the arrow Z, the unfixed toner image T on the recording sheet P may contact the gloss application sheet S, which may disturb the unfixed toner image T. When the heating roller 100 and the pressing roller 200 fix the disturbed toner image T on the recording sheet P, a faulty toner image T may be formed on the recording sheet P.

To address this problem, the image forming apparatus may include two fixing devices, that is, a first fixing device for fixing an unfixed toner image on a recording sheet preliminarily and a second fixing device for fixing the toner image on the recording sheet finally by overlaying a gloss application sheet on the recording sheet. Alternatively, the image forming apparatus may include a single fixing device for fixing an unfixed toner image on a recording sheet preliminarily and then fixing the toner image on the recording sheet a second time when the recording sheet bearing the preliminarily fixed toner image is resent to the fixing device.

The advantage of the configuration employed by the above-described fixing devices is that the gloss application sheet does not disturb the toner image on the recording sheet because the toner image has been fixed preliminarily. However, although generally successful, such a configuration, providing both the preliminary fixing process and the final fixing process, may require more time to perform the two fixing processes, or may require two separate fixing devices or a conveyance mechanism for returning the recording sheet bearing the preliminarily fixed toner image to the fixing device for the second fixing process, thus increasing the overall size of the image forming apparatus.

BRIEF SUMMARY OF THE INVENTION

This specification describes below a fixing device according to exemplary embodiments of the present invention. In one exemplary embodiment of the present invention, the fixing device fixes an unfixed toner image on a recording medium, and includes a heating member, an opposing member, a driver, and a sheet supplier. The heating member applies heat to the unfixed toner image on the recording medium. The opposing member contacts the heating member to form a fixing nip between the heating member and the opposing member. The driver is connected to at least one of the heating member and the opposing member to rotatively drive at least one of the heating member and the opposing member. The sheet supplier is provided upstream from the fixing nip in a sheet conveyance direction to supply and convey a sheet to the fixing nip. The recording medium bearing the unfixed toner image is conveyed through a gap between the sheet and the opposing member at the fixing nip with a side of the recording medium bearing the unfixed toner image facing the sheet. At least one of the rotating heating member and the rotating opposing member applies a driving force to the sheet supplied to the fixing nip while the sheet contacts the sheet supplier to apply tension to the sheet at a position upstream from the fixing nip in the sheet conveyance direction.

This specification describes below an image forming apparatus according to exemplary embodiments of the present invention. In one exemplary embodiment of the present invention, the image forming apparatus includes the fixing device described above.

This specification describes below an image forming method for an image forming apparatus having a fixing device for fixing an unfixed toner image on a recording medium according to exemplary embodiments of the present invention. In one exemplary embodiment of the present invention, the image forming method includes the steps of rotating a rotating member provided upstream from a fixing nip formed between a heating member and an opposing member to convey a sheet to the fixing nip in a sheet conveyance direction, and rotating the heating member and the opposing member to convey the sheet sent from the rotating member. The image forming method further includes the step of applying, using at least one of the rotating heating member and the rotating opposing member, a driving force to the sheet supplied to the fixing nip while the sheet contacts the rotating member to apply tension to the sheet at a position upstream from the fixing nip in the sheet conveyance direction. The image forming method further includes the step of conveying the recording medium bearing the unfixed toner image through a gap between the sheet and the opposing member at the fixing nip with a side of the recording medium bearing the unfixed toner image facing the sheet.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
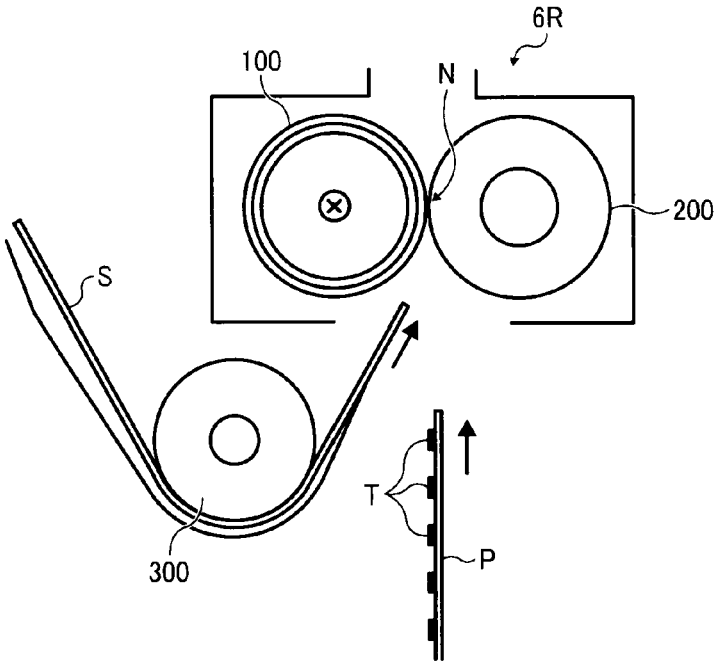
FIG. 1 RELATED ART
FIG. 1 is a schematic view of a related-art fixing device.
Figure 2:
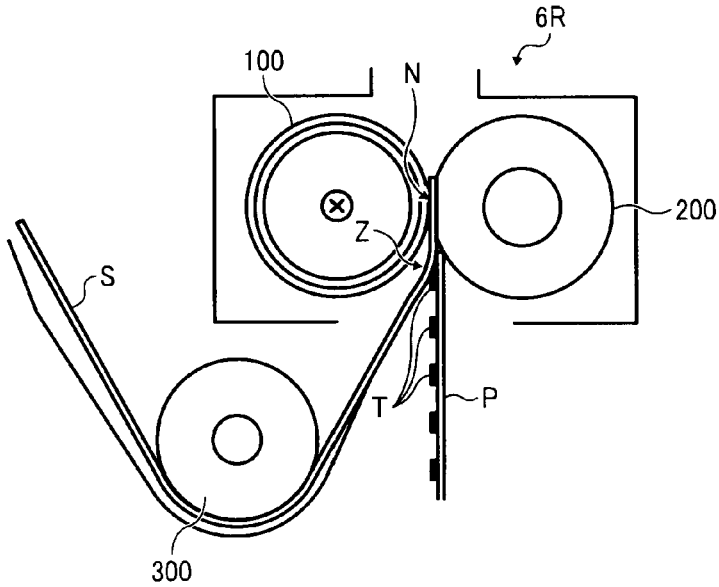
FIG. 2 RELATED ART
FIG. 2 is a schematic view of the related-art fixing device shown in FIG. 1 when a gloss application sheet is separated from a heating roller included in the fixing device.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 3:
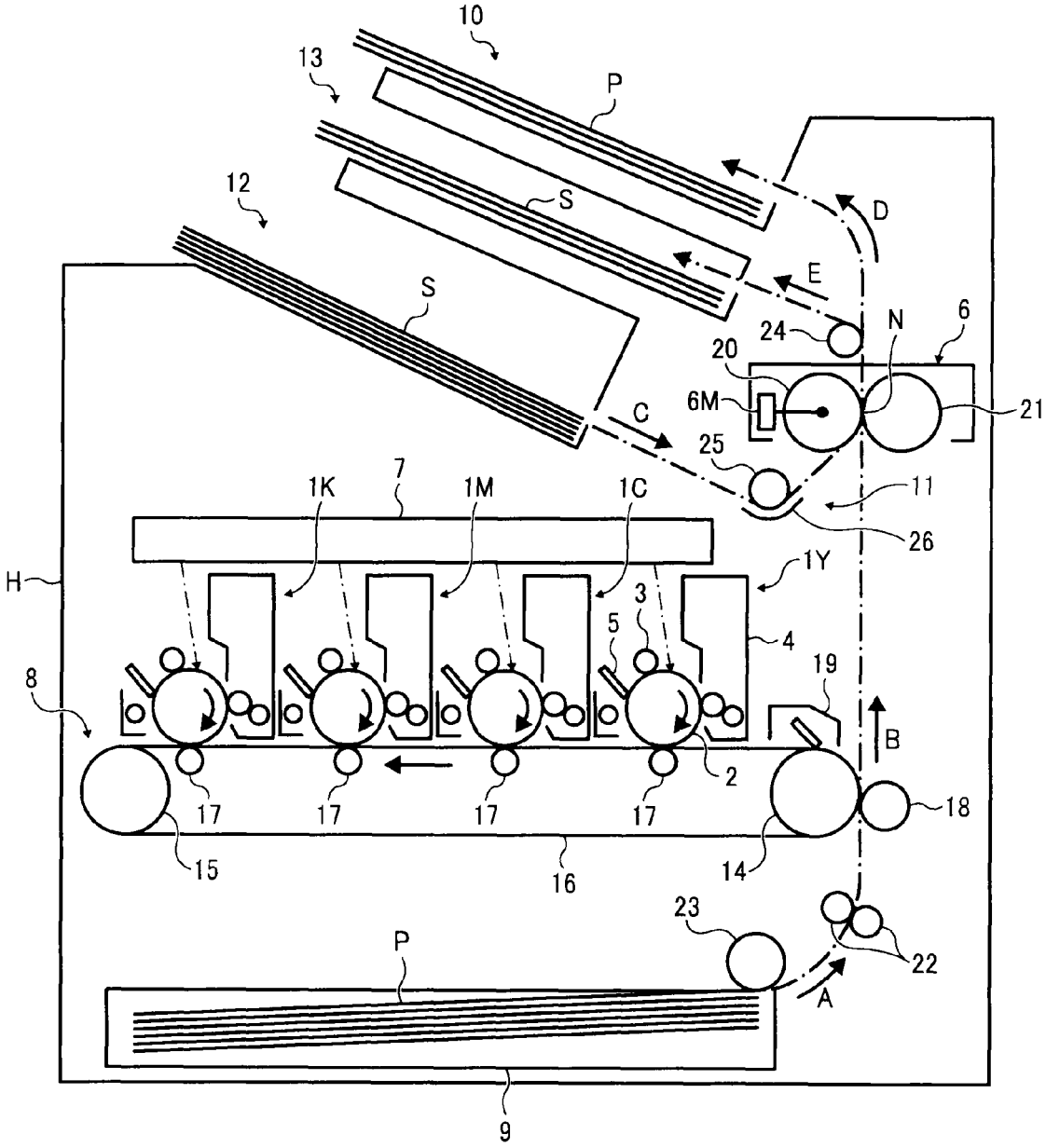
FIG. 3 is a schematic view of an image forming apparatus according to an exemplary embodiment of the present invention.

Referring now to the drawings, wherein like reference numerals designate identical or corresponding parts throughout the several views, in particular to FIG. 3, an image forming apparatus H according to an exemplary embodiment of the present invention is explained.

FIG. 3 is a schematic view of the image forming apparatus H. As illustrated in FIG. 3, the image forming apparatus H includes process units 1Y, 1C, 1M, and 1K, a fixing device 6, an exposure device 7, an intermediate transfer unit 8, a paper tray 9, a stock portion 10, a sheet collector 13, a second transfer roller 18, a belt cleaner 19, a registration roller pair 22, a feed roller 23, and a separation roller 24.

The process units 1Y, 1C, 1M, and 1K include photoconductors 2, charging rollers 3, development devices 4, and cleaning blades 5, respectively.

The intermediate transfer unit 8 includes rollers 14 and 15, an intermediate transfer belt 16, and first transfer rollers 17.

The fixing device 6 includes a driver 6M, a sheet supplier 11, a heating roller 20, and a pressing roller 21. The sheet supplier 11 includes a sheet container 12, a sheet conveyance roller 25, and a guide 26.

As illustrated in FIG. 3, the image forming apparatus H can be a copier, a facsimile machine, a printer, a multifunction printer having at least one of copying, printing, scanning, plotter, and facsimile functions, or the like. According to this exemplary embodiment of the present invention, the image forming apparatus H functions as a tandem color printer for forming a color image on a recording medium.

The image forming apparatus H includes four process units 1Y, 1C, 1M, and 1K, each of which is detachably attached to the image forming apparatus H. The process units 1Y, 1C, 1M, and 1K have an identical structure except that the process units 1Y, 1C, 1M, and 1K contain toner in different colors (e.g., yellow, cyan, magenta, and black) corresponding to color separation components of a color image, respectively. Therefore, the following describes a structure of the process unit 1Y which is equivalent to a structure of the process units 1C, 1M, and 1K.

The process unit 1Y includes the photoconductor 2 serving as an image carrier, the charging roller 3 serving as a charger for charging a surface of the photoconductor 2, the development device 4 serving as a development device for developing an electrostatic latent image formed on the surface of the photoconductor 2 into a toner image, and the cleaning blade 5 serving as a cleaner for cleaning the surface of the photoconductor 2.

The exposure device 7 is provided above the process units 1Y, 1C, 1M, and 1K, and emits laser beams onto the surfaces of the photoconductors 2 of the process units 1Y, 1C, 1M, and 1K, respectively. The intermediate transfer unit 8 is provided below the process units 1Y, 1C, 1M, and 1K. In the intermediate transfer unit 8, the intermediate transfer belt 16 serves as an endless belt looped over a plurality of rollers 14 and 15. The four first transfer rollers 17 serve as first transfer members facing an inner circumferential surface of the intermediate transfer belt 16. The first transfer rollers 17 contact the inner circumferential surface of the intermediate transfer belt 16, and press against the photoconductors 2 via the intermediate transfer belt 16 at positions opposing the photoconductors 2, respectively. In other words, the photoconductors 2 contact an outer circumferential surface of the intermediate transfer belt 16, and press against the first transfer rollers 17 via the intermediate transfer belt 16, respectively. Thus, first transfer nips are formed between the photoconductors 2 and the intermediate transfer belt 16 at the positions at which the first transfer rollers 17 press against the photoconductors 2 via the intermediate transfer belt 16, respectively.

The second transfer roller 18 serves as a second transfer member opposing the roller 14, that is, one of the rollers over which the intermediate transfer belt 16 is looped. The second transfer roller 18 contacts the outer circumferential surface of the intermediate transfer belt 16, and presses against the roller 14 via the intermediate transfer belt 16. Thus, a second transfer nip is formed between the second transfer roller 18 and the intermediate transfer belt 16 at a position at which the second transfer roller 18 presses against the roller 14 via the intermediate transfer belt 16. The belt cleaner 19 faces and cleans the outer circumferential surface of the intermediate transfer belt 16.

The paper tray 9 and the feed roller 23 are provided in a lower portion of the image forming apparatus H. The paper tray 9 contains recording sheets P serving as recording media. The feed roller 23 picks up and feeds a recording sheet P from the paper tray 9. The registration roller pair 22 is provided in a conveyance path connecting the paper tray 9 to the second transfer nip to convey the recording sheet P from the paper tray 9 to the second transfer nip.

The fixing device 6 including the sheet supplier 11, the stock portion 10, the separation roller 24, and the sheet collector 13 are provided in an upper portion of the image forming apparatus H. The fixing device 6 fixes a toner image on the recording sheet P. The stock portion 10 receives and stocks the recording sheet P bearing the fixed toner image. The sheet supplier 11 supplies a gloss application sheet S to a fixing nip N formed between the heating roller 20 and the pressing roller 21 of the fixing device 6. The separation roller 24 serves as a separation member for separating the gloss application sheet S from the recording sheet P. The sheet collector 13 collects the gloss application sheet S separated from the recording sheet P.

The fixing device 6 includes the heating roller 20 and the pressing roller 21. The heating roller 20 serves as a heating member or a heating rotary member inside which a heat source (e.g., a heater) is provided. The pressing roller 21 serves as a pressing member or a pressing rotary member pressed against the heating roller 20 or an opposing member opposing the heating roller 20. The heating roller 20 and the pressing roller 21 press against each other to form the fixing nip N. The driver 6M drives and rotates the heating roller 20. The rotating heating roller 20 drives and rotates the pressing roller 21.

According to this exemplary embodiment, the heating roller 20 and the pressing roller 21 serve as fixing nip formation members for forming the fixing nip N, respectively. Alternatively, at least one rotary member having a belt shape may serve as the fixing nip formation member. Yet alternatively, one of the fixing nip formation members may be rotatable, and another one of the fixing nip formation members may be a pad not rotatable. Yet alternatively, the fixing nip formation members may include a heating member and an opposing member contacting the heating member but not pressing against the heating member.

The heating roller 20 includes a cylindrical member, an elastic layer, and a releasing layer. The elastic layer covers a surface of the cylindrical member, and the releasing layer covers a surface of the elastic layer. The cylindrical member may include a metal material (e.g., aluminum) having a desired mechanical strength and a proper thermal conductivity. However, the metal material included in the cylindrical member is not limited to aluminum. For example, the cylindrical member may include metal such as stainless steel, steel, and brass, and/or an alloy of those having a desired mechanical strength and a proper thermal conductivity.

The elastic layer of the heating roller 20 may include an elastic material such as silicon rubber. Alternatively, the elastic layer of the heating roller 20 may include any material having heat resistance such as fluorocarbon rubber. A method for covering the surface of the cylindrical member with the elastic layer is not limited. For example, the elastic layer may cover the surface of the cylindrical member by injection molding or coating.

The releasing layer may include PFA (tetrafluoroethylene-perfluoroalkoxyethylene copolymer). Alternatively, the releasing layer may include any material having heat resistance and proper releasing property for releasing toner from the heating roller 20 such as fluorocarbon rubber and fluorocarbon resin.

Like the heating roller 20, the pressing roller 21 includes a cylindrical member, an elastic layer, and a releasing layer. The cylindrical member includes metal such as aluminum. The elastic layer covers a surface of the cylindrical member and includes silicon rubber. The releasing layer including PFA covers a surface of the elastic layer.

The sheet supplier 11 includes the sheet container 12 containing gloss application sheets S, the sheet conveyance roller 25 for conveying a gloss application sheet S from the sheet container 12 toward the fixing nip N, and the guide 26 for guiding the gloss application sheet S conveyed by the sheet conveyance roller 25.

The gloss application sheet S may be a thin sheet having a thickness of about 25 μm and including polyester (PET) serving as a base material having heat resistance and suppressing fusion of toner. Alternatively, the gloss application sheet S may include other material and may have other thickness.

Referring to FIG. 3, the following describes basic operations of the image forming apparatus H.

When a driver drives and rotates the photoconductors 2 of the process units 1Y, 1C, 1M, and 1K clockwise in FIG. 3, the charging rollers 3 uniformly charge the surfaces of the photoconductors 2 to have a predetermined polarity, respectively. The exposure device 7 emits laser beams onto the charged surfaces of the photoconductors 2 according to image data to form electrostatic latent images on the surfaces of the photoconductors 2, respectively. The image data may be monochrome image data obtained by resolving a desired full-color image into yellow, cyan, magenta, and black data. The development devices 4 supply yellow, cyan, magenta, and black toner to the electrostatic latent images formed on the photoconductors 2 to make the electrostatic latent images visible as yellow, cyan, magenta, and black toner images, respectively.

When the driver drives and rotates at least one of the rollers 14 and 15 and the first transfer rollers 17 over which the intermediate transfer belt 16 is looped, the intermediate transfer belt 16 rotates counterclockwise in FIG. 3. A voltage controlled to have a constant voltage or a constant current of a polarity opposite to a polarity of charged toner is applied to the first transfer rollers 17 to generate a transfer electric field at the first transfer nips formed between the first transfer rollers 17 and the photoconductors 2, respectively. The transfer electric field generated at the first transfer nips transfers the yellow, cyan, magenta, and black toner images formed on the photoconductors 2 onto the intermediate transfer belt 16 sequentially in such a manner that the yellow, cyan, magenta, and black toner images are superimposed on a same position on the intermediate transfer belt 16. Thus, the outer circumferential surface of the intermediate transfer belt 16 carries a color toner image. After the transfer of the yellow, cyan, magenta, and black toner images, residual toner not transferred onto the intermediate transfer belt 16 may remain on the surfaces of the photoconductors 2. To address this, the cleaning blades 5 remove the residual toner from the photoconductors 2, respectively.

The feed roller 23 rotates and feeds a recording sheet P contained in the paper tray 9 in a direction A toward the registration roller pair 22. The registration roller pair 22 sends the recording sheet P to the second transfer nip formed between the second transfer roller 18 and the intermediate transfer belt 16 at a proper time. A transfer voltage of a polarity opposite to a polarity of the charged toner of the color toner image formed on the intermediate transfer belt 16 is applied to the second transfer roller 18 to generate a transfer electric field at the second nip. The transfer electric field generated at the second transfer nip transfers the color toner image formed on the intermediate transfer belt 16 onto the recording sheet P at a time. The recording sheet P bearing the color toner image is conveyed from the second transfer nip toward the fixing device 6 in a direction B. After the transfer of the color toner image from the intermediate transfer belt 16 onto the recording sheet P, the belt cleaner 19 removes residual toner remaining on the intermediate transfer belt 16 from the intermediate transfer belt 16.

On the other hand, a gloss application sheet S is sent from the sheet container 12 toward the sheet conveyance roller 25 in a direction C. The sheet conveyance roller 25 rotates and feeds the gloss application sheet S toward the fixing nip N of the fixing device 6. According to this exemplary embodiment, the gloss application sheet S enters the fixing nip N slightly before the recording sheet P enters the fixing nip N.

The gloss application sheet S and the recording sheet P enter the fixing nip N formed between the heating roller 20 and the pressing roller 21 in a state in which the gloss application sheet S is overlaid on an image side of the recording sheet P which bears an unfixed toner image. The rotating heating roller 20 and the rotating pressing roller 21 convey the gloss application sheet S and the recording sheet P while applying heat and pressure to the gloss application sheet S and the recording sheet P. Heat applied by the heating roller 20 is transmitted to the unfixed toner image on the recording sheet P via the gloss application sheet S to melt and fix the toner image on the recording sheet P.

When the gloss application sheet S and the recording sheet P are discharged out of the fixing device 6, the separation roller 24 separates the gloss application sheet S from the recording sheet P. The recording sheet P separated from the gloss application sheet S is conveyed in a direction D, and is discharged onto the stock portion 10. On the other hand, the gloss application sheet S separated from the recording sheet P is conveyed in a direction E, and is discharged onto the sheet collector 13. As described above, the gloss application sheet S is overlaid on the image side of the recording sheet P which bears the unfixed toner image, and the toner image is fixed on the recording sheet P. Thereafter, the gloss application sheet S is peeled off the recording sheet P. Accordingly, the toner image fixed on the image side of the recording sheet P is smoothed into a glossy toner image.

The above describes an image forming operation for forming a full-color toner image on a recording sheet P. Alternatively, one of the four process units 1Y, 1C, 1M, and 1K may be used to form a monochrome toner image. Yet alternatively, two or three of the four process units 1Y, 1C, 1M, and 1K may be used to form a two-color toner image or a three-color toner image, respectively.

A gloss application sheet S may be selectively supplied to the fixing nip N of the fixing device 6 whenever a recording sheet P is conveyed through the fixing device 6 as gloss application to the toner image is needed. For example, when gloss application is needed for photo printing, a gloss application sheet S may be supplied to the fixing nip N of the fixing device 6 so that the gloss application sheet S is overlaid on an image side of a recording sheet P which bears a toner image, and the toner image is fixed on the recording sheet P as described above. Thus, a glossy toner image may be formed. By contrast, when gloss application is not needed for text printing, a gloss application sheet S may not be supplied to the fixing nip N of the fixing device 6 and therefore only a recording sheet P may be sent to the fixing device 6. Thereafter, a toner image may be fixed on the recording sheet P. Accordingly, usage of gloss application sheets S may be minimized.

Figure 4:
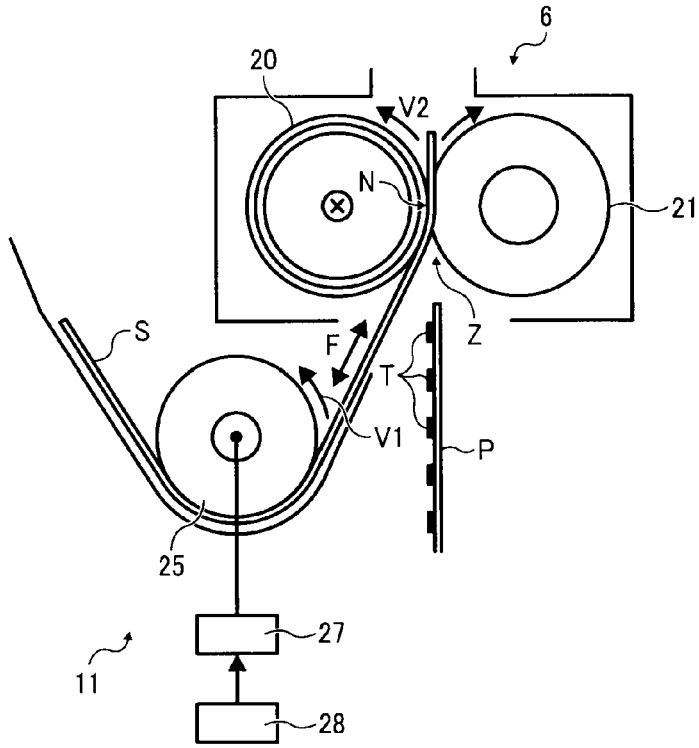
FIG. 4 is a schematic view of a fixing device included in the image forming apparatus shown in FIG. 3.

Referring to FIG. 4, the following describes the fixing device 6 including the sheet supplier 11. FIG. 4 is a schematic view of the fixing device 6. As illustrated in FIG. 4, the sheet supplier 11 further includes a motor 27 and a controller 28.

The motor 27 serves as a driving source for driving and rotating the sheet conveyance roller 25 counterclockwise in FIG. 4. The rotating sheet conveyance roller 25 serves as a rotating member for conveying a gloss application sheet S to the fixing nip N of the fixing device 6. The driver 6M depicted in FIG. 3 drives and rotates the heating roller 20 serving as a heating member counterclockwise in FIG. 4. The rotating heating roller 20 drives and rotates the pressing roller 21 serving as an opposing member clockwise in FIG. 4. When the gloss application sheet S enters the fixing nip N, the rotating heating roller 20 and the rotating pressing roller 21 convey the gloss application sheet S upward in FIG. 4. As described above, in order to fix an unfixed toner image T on a recording sheet P, the recording sheet P enters the fixing nip N so that the gloss application sheet S is overlaid on the unfixed toner image T on the recording sheet P.

A tension F is applied to the gloss application sheet S reaching the fixing nip N. Specifically, when the gloss application sheet S reaches the fixing nip N while the gloss application sheet S contacts the sheet conveyance roller 25, the rotating sheet conveyance roller 25 applies a pushing force for pushing the gloss application sheet S to the fixing nip N to the gloss application sheet S. Simultaneously, the rotating heating roller 20 applies a pulling force for pulling the gloss application sheet S to the gloss application sheet S. When the pulling force is greater than the pushing force, the tension F is applied to the gloss application sheet S at a position upstream from the fixing nip N in a sheet conveyance direction for conveying the gloss application sheet S.

When the gloss application sheet S reaches the fixing nip N while the gloss application sheet S contacts the sheet conveyance roller 25 as illustrated in FIG. 4, a circumferential velocity V2, that is, an outer circumferential velocity, of the heating roller 20 is greater than a circumferential velocity V1, that is, an outer circumferential velocity, of the sheet conveyance roller 25 to cause the pulling force applied to the gloss application sheet S by the heating roller 20 to be greater than the pushing force applied to the gloss application sheet S by the sheet conveyance roller 25.

For example, the controller 28 is connected to the motor 27 for driving and rotating the sheet conveyance roller 25, and controls output of the motor 27. In other words, the controller 28 controls the circumferential velocity V1 of the sheet conveyance roller 25 to be smaller than the circumferential velocity V2 of the heating roller 20.

The circumferential velocity V1 of the sheet conveyance roller 25 may not be smaller than the circumferential velocity V2 of the heating roller 20 constantly. For example, according to this exemplary embodiment, at a predetermined time immediately after the gloss application sheet S reaches the fixing nip N, the controller 28 decreases output of the motor 27 to decrease the circumferential velocity V1 of the sheet conveyance roller 25. Thus, the circumferential velocity V1 of the sheet conveyance roller 25 becomes smaller than the circumferential velocity V2 of the heating roller 20. In other words, the circumferential velocity V1 of the sheet conveyance roller 25 is greater than the circumferential velocity V2 of the heating roller 20 before the controller 28 decreases the circumferential velocity V1 of the sheet conveyance roller 25. Alternatively, the controller 28 may turn off output of the motor 27 instead of decreasing output of the motor 27 to decrease the circumferential velocity V1 of the sheet conveyance roller 25 so that the circumferential velocity V1 of the sheet conveyance roller 25 becomes smaller than the circumferential velocity V2 of the heating roller 20.

The predetermined time at which the controller 28 decreases the circumferential velocity V1 of the sheet conveyance roller 25 may be determined by measuring in advance a time period from start of driving the sheet conveyance roller 25 or start of conveying the gloss application sheet S until the gloss application sheet S reaches a predetermined position after the gloss application sheet S enters the fixing nip N. In this case, the controller 28 decreases the circumferential velocity V1 of the sheet conveyance roller 25 when the measured time period is counted after the controller 28 detects start of driving the sheet conveyance roller 25 or start of conveying the gloss application sheet S.

Figure 5:
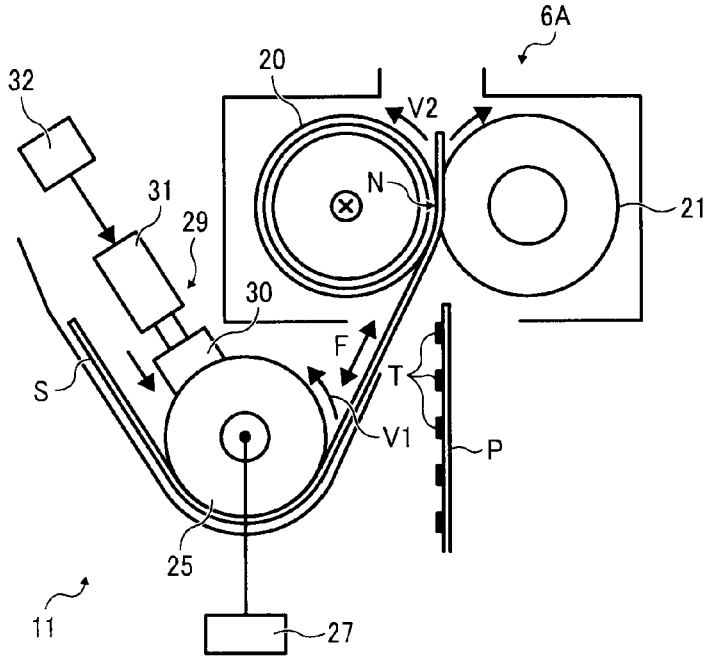
FIG. 5 is a schematic view of a fixing device according to another exemplary embodiment of the present invention.

FIG. 5 is a schematic view of a fixing device 6A. As illustrated in FIG. 5, the fixing device 6A includes a brake 29. The brake 29 includes a brake pad 30, a piston cylinder unit 31, and a controller 32. The other elements of the fixing device 6A are equivalent to the elements of the fixing device 6 depicted in FIG. 4.

The brake 29 applies a braking force to the sheet conveyance roller 25. The piston cylinder unit 31 serves as a contact-separate mechanism for causing the brake pad 30 to contact and separate from an outer circumferential surface of the sheet conveyance roller 25. The controller 32 controls contraction and expansion of the piston cylinder unit 31. For example, an instruction issued by the controller 32 expands the piston cylinder unit 31 to cause the brake pad 30 to contact the sheet conveyance roller 25, thus decreasing the circumferential velocity V1 of the sheet conveyance roller 25. As described above, in the fixing device 6A, the brake 29 decreases the circumferential velocity V1 of the sheet conveyance roller 25 at a predetermined time so that the circumferential velocity V1 of the sheet conveyance roller 25 becomes smaller than the circumferential velocity V2 of the heating roller 20.

Figure 6:
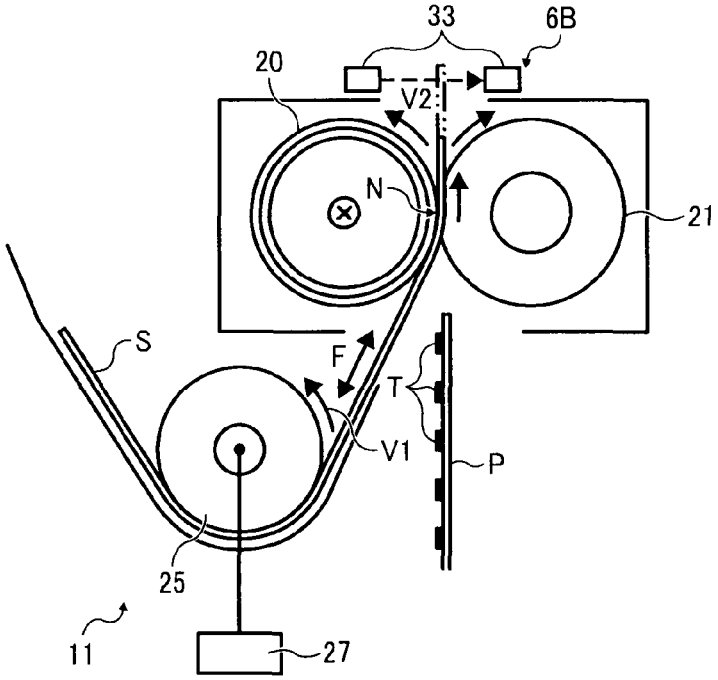
FIG. 6 is a schematic view of a fixing device according to yet another exemplary embodiment of the present invention.

FIG. 6 is a schematic view of a fixing device 6B. As illustrated in FIG. 6, the fixing device 6B includes a non-contact sensor 33. The other elements of the fixing device 6B are equivalent to the elements of the fixing device 6 depicted in FIG. 4.

The non-contact sensor 33 is provided at a position downstream from the fixing nip N in the sheet conveyance direction for conveying the gloss application sheet S, and serves as a sheet detector for detecting the gloss application sheet S. When a leading edge of the gloss application sheet S passes through the fixing nip N and reaches a predetermined position illustrated in a chain double-dashed line in FIG. 6, the non-contact sensor 33 detects the leading edge of the gloss application sheet S. Alternatively, the sheet detector may be a contact sensor for detecting the gloss application sheet S which reaches the predetermined position by contacting the gloss application sheet S.

The controller 28 depicted in FIG. 4 decreases the circumferential velocity V1, that is, a rotation velocity, of the sheet conveyance roller 25 based on a detection signal provided by the non-contact sensor 33 so that the circumferential velocity V1 of the sheet conveyance roller 25 becomes smaller than the circumferential velocity V2 of the heating roller 20. In order to decrease the circumferential velocity V1 of the sheet conveyance roller 25, the controller 28 may control output of the motor 27 to the sheet conveyance roller 25 as illustrated in FIG. 4 or the controller 32 may control the braking force applied by the brake 29 to the sheet conveyance roller 25 as illustrated in FIG. 5. Alternatively, a braking force (e.g., a conveyance resistance) may be applied to the gloss application sheet S directly to apply tension to the gloss application sheet S.

Figure 7:
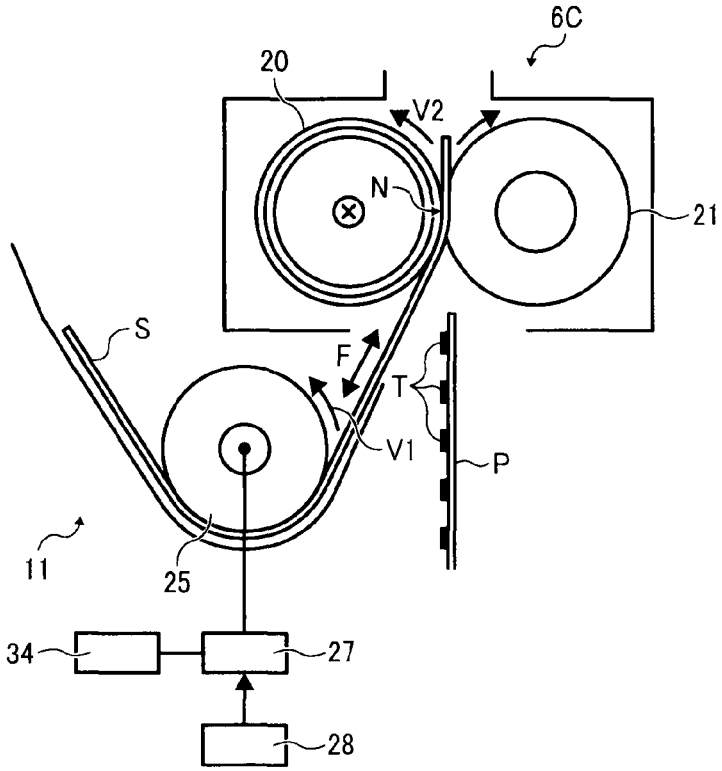
FIG. 7 is a schematic view of a fixing device according to yet another exemplary embodiment of the present invention.

FIG. 7 is a schematic view of a fixing device 6C. As illustrated in FIG. 7, the fixing device 6C includes a torque limiter 34. The other elements of the fixing device 6C are equivalent to the elements of the fixing device 6 depicted in FIG. 4.

In the fixing device 6C, like in the fixing device 6 depicted in FIG. 4, the controller 28 controls output of the motor 27 for driving the sheet conveyance roller 25 to decrease the circumferential velocity V1 of the sheet conveyance roller 25 at a predetermined time so that the tension F is applied to the gloss application sheet S. The torque limiter 34 is connected to the motor 27. When the tension F applied to the gloss application sheet S exceeds a predetermined threshold value, the torque limiter 34 allows idling of the sheet conveyance roller 25. When a rotation torque is applied to the sheet conveyance roller 25 in a rotation direction in which the sheet conveyance roller 25 conveys the gloss application sheet S, the torque limiter 34 is not activated. When a rotation torque exceeding a predetermined value is applied in a direction opposite to the rotation direction in which the sheet conveyance roller 25 conveys the gloss application sheet S, the torque limiter 34 is activated. When the torque limiter 34 is activated, connection between the motor 27 and sheet conveyance roller 25 is released to allow idling of the sheet conveyance roller 25.

Figure 8:
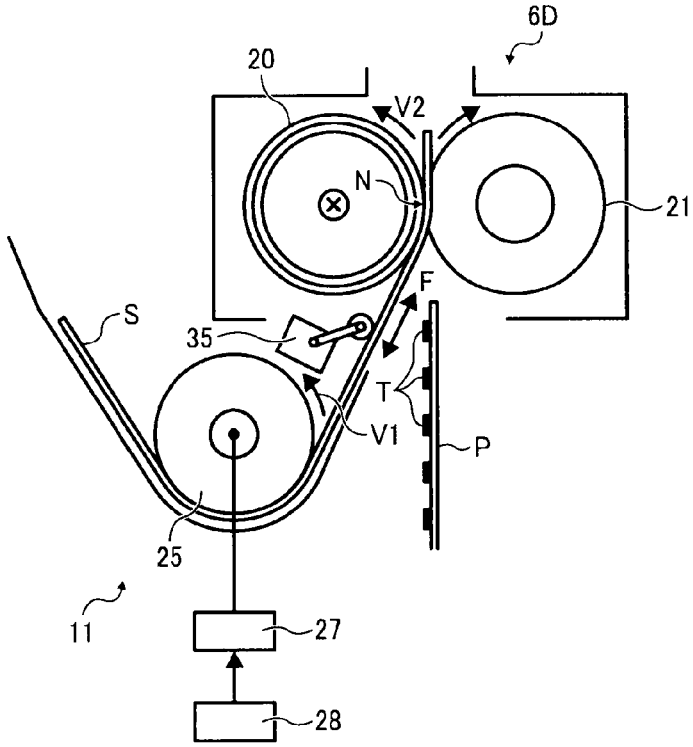
FIG. 8 is a schematic view of a fixing device according to yet another exemplary embodiment of the present invention.

FIG. 8 is a schematic view of a fixing device 6D. As illustrated in FIG. 8, the fixing device 6D includes a tension measurement device 35. The other elements of the fixing device 6D are equivalent to the elements of the fixing device 6 depicted in FIG. 4.

In the fixing device 6D, like in the fixing device 6 depicted in FIG. 4, the controller 28 controls output of the motor 27 for driving the sheet conveyance roller 25 to decrease the circumferential velocity V1 of the sheet conveyance roller 25 at a predetermined time so that the tension F is applied to the gloss application sheet S. The contact tension measurement device 35 serves as a tension detector for detecting the tension F applied to the gloss application sheet S. The tension measurement device 35 contacts the gloss application sheet S at a position between the sheet conveyance roller 25 and the heating roller 20. The tension measurement device 35 includes a contact portion for contacting the gloss application sheet S and swings in accordance with movement of the gloss application sheet S. The tension measurement device 35 detects a swing angle of the contact portion to measure a degree of stretch of the gloss application sheet S, that is, a degree of tension applied to the gloss application sheet S. Structure of the tension measurement device 35 is not limited to the structure shown in FIG. 8. For example, the tension measurement device 35 may be a non-contact tension measurement device.

The tension F applied to the gloss application sheet S may fluctuate in accordance with change in a relative relation between the pushing force generated by the rotating sheet conveyance roller 25 to push the gloss application sheet S toward the fixing nip N and the pulling force generated by the rotating heating roller 20 to pull the gloss application sheet S. To address this, the controller 28 controls output of the motor 27 for driving the sheet conveyance roller 25 based on a detection signal provided by the tension measurement device 35, so as to adjust the tension F applied to the gloss application sheet S to a predetermined value.

Figure 9:
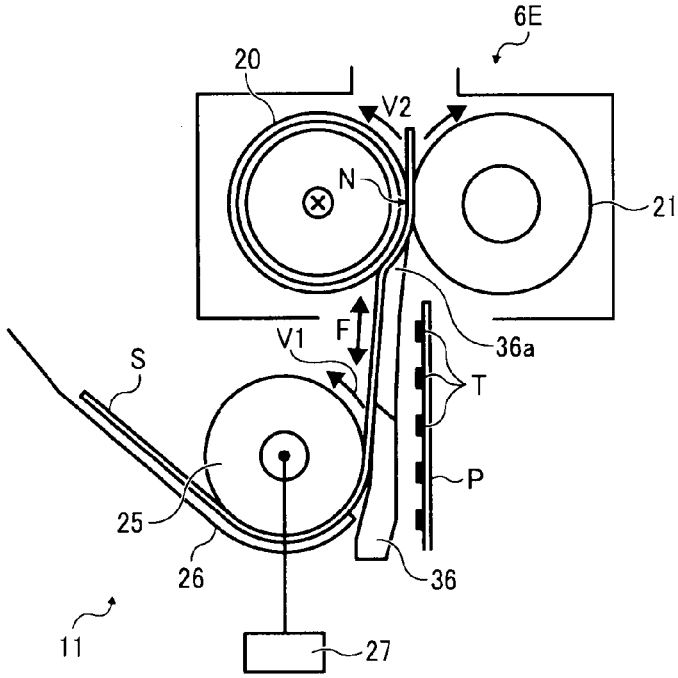
FIG. 9 is a schematic view of a fixing device according to yet another exemplary embodiment of the present invention.

FIG. 9 is a schematic view of a fixing device 6E. As illustrated in FIG. 9, the fixing device 6E includes a guide 36. The guide 36 includes a leading edge portion 36*a*. The other elements of the fixing device 6E are equivalent to the elements of the fixing device 6 depicted in FIG. 4.

The guide 36 is provided along a conveyance path provided between the sheet conveyance roller 25 and the heating roller 20, and serves as a guide member for guiding the gloss application sheet S from the sheet conveyance roller 25 to the heating roller 20. The leading edge portion 36*a* of the guide 36 is provided near an entry to the fixing nip N to oppose the heating roller 20. The guide 36 is provided at a position at which the guide 36 does not contact or interfere with the recording sheet P conveyed toward the fixing nip N. According to this exemplary embodiment, the guide 26 for guiding the gloss application sheet S from the sheet container 12 (depicted in FIG. 3) to the sheet conveyance roller 25 is separately provided from the guide 36 for guiding the gloss application sheet S from the sheet conveyance roller 25 to the fixing nip N. Alternatively, the two guides 26 and 36 may be integrated into a single unit.

In the fixing device 6E, like in the fixing devices 6, 6A, 6B, 6C, and 6D depicted in FIGS. 4, 5, 6, 7, and 8, respectively, the circumferential velocity V1 of the sheet conveyance roller 25 is adjusted to be smaller than the circumferential velocity V2 of the heating roller 20 at a predetermined time to apply the tension F to the gloss application sheet S. A method for adjusting the circumferential velocities V1 and V2 of the sheet conveyance roller 25 and the heating roller 20, respectively, may be selected among options, that is, controlling output of the motor 27 for driving the sheet conveyance roller 25 as illustrated in FIG. 4, applying the braking force to the sheet conveyance roller 25 with the brake 29 as illustrated in FIG. 5, applying the braking force (e.g., the conveyance resistance) to the gloss application sheet S, and the like.

Figure 10A:
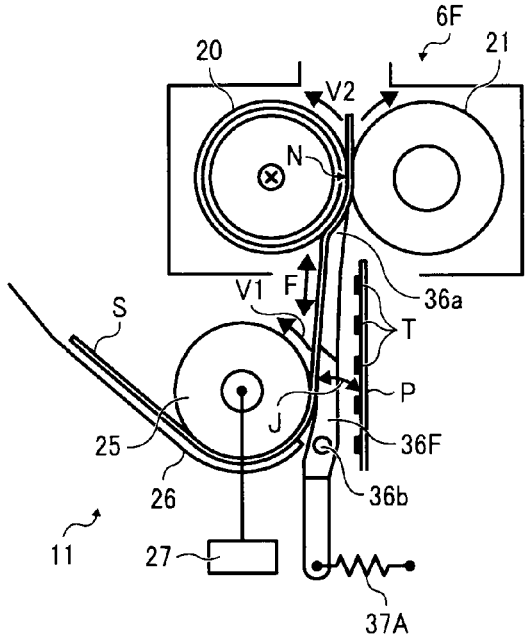
FIG. 10A is a schematic view of a fixing device according to yet another exemplary embodiment of the present invention.

FIG. 10A is a schematic view of a fixing device 6F. As illustrated in FIG. 10A, the fixing device 6F includes a guide 36F and a tension spring 37A. The guide 36F includes the leading edge portion 36*a* and a support shaft 36*b*. The other elements of the fixing device 6F are equivalent to the elements of the fixing device 6E depicted in FIG. 9.

In the fixing device 6F, like in the fixing device 6E depicted in FIG. 9, the guide 36F is provided along the conveyance path provided between the sheet conveyance roller 25 and the heating roller 20, and serves as a guide member for guiding the gloss application sheet S from the sheet conveyance roller 25 to the heating roller 20. However, the guide 36F is swingable about the support shaft 36*b* in a direction J. As the guide 36F swings, the leading edge portion 36*a* of the guide 36F, which opposes the heating roller 20, moves closer to and away from the heating roller 20.

The tension spring 37A serving as a biasing member applies a biasing force to the guide 36F to move the guide 36F closer to the heating roller 20. One end of the tension spring 37A is attached to the guide 36F and another end of the tension spring 37A is attached to a frame of the fixing device 6F, for example. The tension spring 37A pulls the guide 36F to move the guide 36F toward the heating roller 20.

Figure 10B:
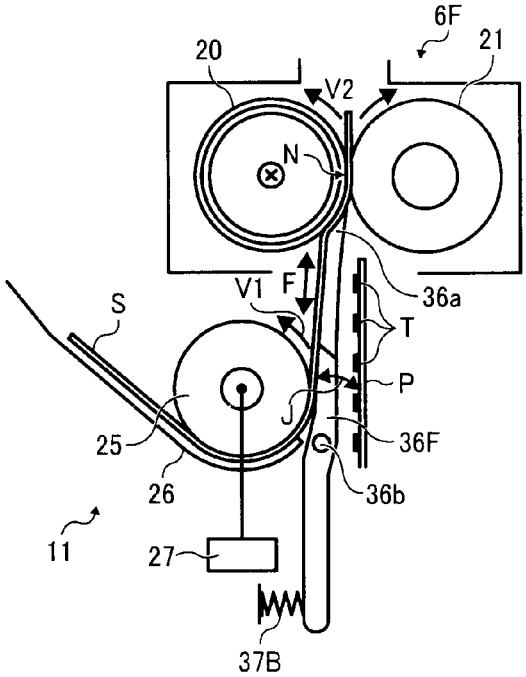
FIG. 10B is a schematic view of the fixing device shown in FIG. 10A illustrating a variation of a biasing member included in the fixing device.

Alternatively, the fixing device 6F may include a compression spring 37B replacing the tension spring 37A depicted in FIG. 10A. FIG. 10B is a schematic view of the fixing device 6F including the compression spring 37B. The compression spring 37B serving as a biasing member applies a biasing force to the guide 36F to move the guide 36F closer to the heating roller 20. One end of the compression spring 37B is attached to the guide 36F and another end of the compression spring 37B is attached to the frame of the fixing device 6F, for example. The compression spring 37B presses against the guide 36F to move the guide 36F toward the heating roller 20.

Figure 10C:
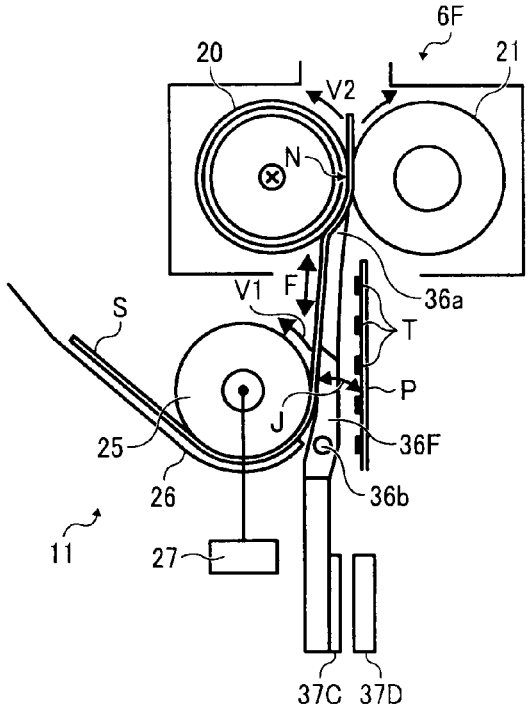
FIG. 10C is a schematic view of the fixing device shown in FIG. 10A illustrating another variation of the biasing member.

Yet alternatively, the fixing device 6F may include a magnetic body 37C and a magnet 37D serving as a biasing member which replaces the tension spring 37A depicted in FIG. 10A. FIG. 10C is a schematic view of the fixing device 6F including the magnetic body 37C and the magnet 37D. The magnetic body 37C is provided on the guide 36F and the magnet 37D is provided on the frame of the fixing device 6F, for example. The magnet 37D attracts the magnetic body 37C to apply a biasing force to the guide 36F to move the guide 36F closer to the heating roller 20. Instead of the magnetic body 37C and the magnet 37D, the fixing device 6F may include two magnets attracting each other, that is, a magnet provided on the guide 36F and another magnet provided on the frame of the fixing device 6F, for example. Alternatively, the fixing device 6F may include a magnet provided on the guide 36F and a magnetic body provided on the frame of the fixing device 6F, for example.

Figure 11:
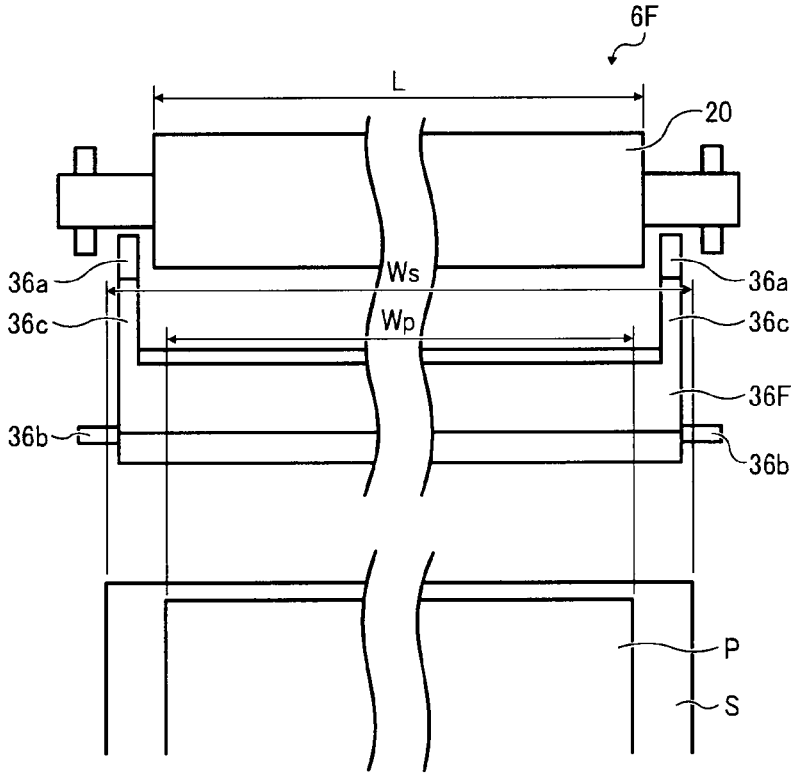
FIG. 11 is an axial view of a guide and a heating roller included in the fixing device shown in FIG. 10A in an axial direction of the heating roller.

FIG. 11 is an axial view of the guide 36F and the heating roller 20 seen in a direction perpendicular to a direction in which the fixing device 6F is seen in FIG. 10A. As illustrated in FIG. 11, the guide 36F further includes an arm 36*c*.

The arm 36*c* may be a pair of arms extending from both ends of the guide 36F in a longitudinal direction of the guide 36F corresponding to an axial direction of the heating roller 20 toward the heating roller 20. A width of the gloss application sheet S is greater than a width of the recording sheet P. Specifically, a passage width Ws through which the gloss application sheet S passes is greater than a passage width Wp through which the recording sheet P passes.

Each of the arms 36*c* is provided outboard of the passage width Wp of the recording sheet P and inboard of the passage width Ws of the gloss application sheet S. When the fixing device 6F accommodates various sizes of recording sheets P, each of the arms 36*c* is provided outboard of a maximum passage width of the recording sheets P. According to this exemplary embodiment, each of the arms 36*c* is provided outboard of the passage width Wp of the recording sheet P and outboard of a length L of a roller portion of the heating roller 20, that is, a portion other than a shaft of the heating roller 20, in the axial direction of the heating roller 20. Accordingly, even when the aims 36*c* move toward the heating roller 20, the arms 36*c* do not contact the roller portion of the heating roller 20. In order to prevent the arms 36*c* from contacting the heating roller 20, a stopper may stop the arms 36*c* at predetermined positions, respectively, against the biasing force applied by the biasing member, that is, the tension spring 37A depicted in FIG. 10A, the compression spring 37B depicted in FIG. 10B, or the magnetic body 37C and the magnet 37D depicted in FIG. 10C.

The structure of the fixing device 6F other than the above-described structure explained by referring to FIGS. 10A, 10B, 10C, and 11 is equivalent to the structure explained by referring to FIG. 9. Alternatively, the guide 36 shown in FIG. 9 may include the aims 36*c* provided outboard of the passage width Wp of the recording sheet P and inboard of the passage width Ws of the gloss application sheet S like the guide 36F shown in FIG. 11.

The following describes operations and effects of the fixing devices 6, 6A, 6B, 6C, 6D, 6E, and 6F depicted in FIGS. 4 to 10C, respectively.

In the fixing device 6 depicted in FIG. 4, the controller 28 decreases output of the motor 27 at a predetermined time immediately after the gloss application sheet S reaches the fixing nip N to decrease the circumferential velocity V1 of the sheet conveyance roller 25 to a level smaller than the circumferential velocity V2 of the heating roller 20. Accordingly, the pulling force generated by the rotating heating roller 20 to pull the gloss application sheet S becomes greater than the pushing force generated by the rotating sheet conveyance roller 25 to push the gloss application sheet S toward the fixing nip N. Consequently, the tension F is applied to the gloss application sheet S at the position upstream from the fixing nip N in the sheet conveyance direction for conveying the gloss application sheet S, that is, a position below the fixing nip N in FIG. 4. Thus, the gloss application sheet S is stretched between the sheet conveyance roller 25 and the heating roller 20 without being bent. Accordingly, the gloss application sheet S does not separate from the outer circumferential surface of the heating roller 20 at a position near the entry to the fixing nip N indicated by arrow Z in FIG. 4. As a result, before the recording sheet P enters the fixing nip N, an unfixed toner image T on the recording sheet P does not contact the gloss application sheet S, preventing generation of image noise.

In the fixing device 6, the controller 28 decreases output of the motor 27 to decrease the circumferential velocity V1 of the sheet conveyance roller 25. Alternatively, the controller 28 may turn off output of the motor 27 so that the sheet conveyance roller 25 is driven and rotated by the gloss application sheet S to apply the tension F to the gloss application sheet S. Further, when output of the motor 27 is turned off to cause the sheet conveyance roller 25 to be driven and rotated by the gloss application sheet S, the tension F applied to the gloss application sheet S may not increase excessively, preventing damage to the gloss application sheet S and maintaining durability of the sheet conveyance roller 25 and the heating roller 20.

In the fixing device 6A depicted in FIG. 5, the brake 29 applies the braking force to the sheet conveyance roller 25 to cause the circumferential velocity V1 of the sheet conveyance roller 25 to be smaller than the circumferential velocity V2 of the heating roller 20. Thus, the tension F is applied to the gloss application sheet S. Alternatively, the brake 29 may apply the braking force (e.g., the conveyance resistance) to the gloss application sheet S directly to apply tension to the gloss application sheet S.

According to the above-described exemplary embodiments, the circumferential velocity V1 of the sheet conveyance roller 25 is decreased at a predetermined time immediately after the gloss application sheet S reaches the fixing nip N. Alternatively, the circumferential velocity V1 of the sheet conveyance roller 25 may be decreased at other time as long as the circumferential velocity V1 of the sheet conveyance roller 25 is smaller than the circumferential velocity V2 of the heating roller 20 when the gloss application sheet S reaches the fixing nip N while the gloss application sheet S contacts the sheet conveyance roller 25. For example, the circumferential velocity V1 of the sheet conveyance roller 25 may be decreased at a predetermined time before the gloss application sheet S reaches the fixing nip N.

Alternatively, the tension F may be applied to the gloss application sheet S by maintaining the circumferential velocity V1 of the sheet conveyance roller 25 to be smaller than the circumferential velocity V2 of the heating roller 20 constantly. In this case, a mechanism for switching (e.g., adjusting) the rotation velocity of the sheet conveyance roller 25 is not needed, simplifying the structure of the fixing device 6A and reducing manufacturing costs of the fixing device 6A. On the other hand, with the configuration for decreasing the circumferential velocity V1 of the sheet conveyance roller 25, the circumferential velocity V1 of the sheet conveyance roller 25 is greater than the circumferential velocity V2 of the heating roller 20 before a predetermined time at which the circumferential velocity V1 of the sheet conveyance roller 25 is decreased. Accordingly, the gloss application sheet S can be conveyed faster compared to the configuration for maintaining the circumferential velocity V1 of the sheet conveyance roller 25 to be smaller than the circumferential velocity V2 of the heating roller 20 constantly.

In the fixing device 6B depicted in FIG. 6, when the non-contact sensor 33 detects the leading edge of the gloss application sheet S, the circumferential velocity V1 of the sheet conveyance roller 25 is decreased based on a detection signal provided by the non-contact sensor 33 so that the circumferential velocity V1 of the sheet conveyance roller 25 is smaller than the circumferential velocity V2 of the heating roller 20. The non-contact sensor 33 detects the gloss application sheet S passing through the fixing nip N precisely. Accordingly, the circumferential velocity V1 of the sheet conveyance roller 25 is decreased at a proper time to apply the tension F to the gloss application sheet S, preventing the toner image T on the recording sheet P from contacting the gloss application sheet S at the entry to the fixing nip N precisely.

In the fixing device 6C depicted in FIG. 7, when the tension F is applied to the gloss application sheet S like in the fixing devices 6, 6A, and 6B depicted in FIGS. 4, 5, and 6, respectively, and the tension F exceeds the predetermined threshold value, the torque limiter 34 is activated to release connection between the motor 27 and the sheet conveyance roller 25. Accordingly, the sheet conveyance roller 25 idles in accordance with movement of the gloss application sheet S. In other words, the sheet conveyance roller 25 idles in a direction in which the gloss application sheet S is pulled by the heating roller 20. Consequently, the gloss application sheet S is conveyed while being applied with the substantially constant tension F. Namely, the torque limiter 34 serves as a tension adjuster for adjusting the tension F applied to the gloss application sheet S. Accordingly, the gloss application sheet S is not pulled excessively, and therefore the excessive tension F is not applied to the gloss application sheet S, preventing damage to the gloss application sheet S and maintaining durability of the sheet conveyance roller 25 and the heating roller 20.

In the fixing device 6D depicted in FIG. 8, the tension measurement device 35 detects or measures the tension F applied to the gloss application sheet S. The controller 28 controls output of the motor 27 based on a detection signal (e.g., a measurement value) provided by the tension measurement device 35 to adjust the circumferential velocity V1 of the sheet conveyance roller 25. Thus, the tension F applied to the gloss application sheet S is maintained at a predetermined value. Unlike with the torque limiter 34 of the fixing device 6C depicted in FIG. 7, the tension F is changed to an arbitrary value and maintained. In other words, the maximum tension F applied to the gloss application sheet S is set in accordance with strength of the gloss application sheet S or the like.

In the fixing device 6E depicted in FIG. 9, the guide 36 is provided between the sheet conveyance roller 25 and the heating roller 20. The guide 36 guides the gloss application sheet S to the fixing nip N. The guide 36 opposes the heating roller 20 at the position near the entry to the fixing nip N. Accordingly, the gloss application sheet S guided by the guide 36 contacts the outer circumferential surface of the heating roller 20 at the position near the entry to the fixing nip N. Like in the fixing devices 6, 6A, 6B, 6C, and 6D depicted in FIGS. 4, 5, 6, 7, and 8, respectively, the circumferential velocity V1 of the sheet conveyance roller 25 is smaller than the circumferential velocity V2 of the heating roller 20 to apply the tension F to the gloss application sheet S. Accordingly, the gloss application sheet S is conveyed along the guide 36 stably without being bent.

The guide 36 and the tension F prevent the gloss application sheet S from separating from the heating roller 20 at the position near the entry to the fixing nip N. Accordingly, the unfixed toner image T on the recording sheet P does not contact the gloss application sheet S, suppressing image noise. Further, the guide 36 is provided at a position at which the guide 36 does not interfere with movement of the recording sheet P. Accordingly, the unfixed toner image T on the recording sheet P does not contact the guide 36.

Alternatively, the guide 36 may cause the gloss application sheet S to contact the heating roller 20 without applying the tension F to the gloss application sheet S so as to prevent the gloss application sheet S from separating from the heating roller 20 at the position near the entry to the fixing nip N. In order to prevent the gloss application sheet S from separating from the heating roller 20 precisely, the leading edge portion 36*a* of the guide 36 may be provided as close as possible to the fixing nip N. However, the recording sheet P may contact the guide 36. To address this problem, as described above, the tension F is applied to the gloss application sheet S to prevent the gloss application sheet S from separating from the heating roller 20 in a region provided between the leading edge portion 36*a* of the guide 36 and the fixing nip N precisely.

The guide 36 causes the gloss application sheet S to contact the heating roller 20 to increase an area, in which the gloss application sheet S contacts the heating roller 20, provided upstream from the fixing nip N in the sheet conveyance direction. Accordingly, the heating roller 20 starts heating the gloss application sheet S at an earlier time, and supplies heat to the gloss application sheet S for a longer time. Consequently, the heating roller 20 heats the gloss application sheet S effectively with less thermal energy, thus saving energy and reducing manufacturing costs of the fixing device 6E.

In the fixing device 6F depicted in FIGS. 10A, 10B, and 10C, like in the fixing device 6E depicted in FIG. 9, the guide 36F is provided between the sheet conveyance roller 25 and the heating roller 20. The guide 36F and the tension F cause the gloss application sheet S to contact the outer circumferential surface of the heating roller 20 at least at a position near the entry to the fixing nip N, preventing the gloss application sheet S from separating from the heating roller 20 at the position near the entry to the fixing nip N precisely. Further, the heating roller 20 heats the gloss application sheet S effectively with less thermal energy.

The leading edge portion 36*a* of the guide 36F moves closer to and away from the heating roller 20 to adjust a gap between the leading edge portion 36*a* of the guide 36F and the heating roller 20 in accordance with thickness of the gloss application sheet S. Accordingly, even when gloss application sheets S of various thicknesses are conveyed through the fixing device 6F, the guide 36F guides the gloss application sheets S stably and smoothly, and causes the gloss application sheet S to contact the heating roller 20 precisely.

In the fixing device 6F depicted in FIG. 11, the pair of arms 36*c* of the guide 36F is provided outboard of the length L of the roller portion of the heating roller 20 in the axial direction of the heating roller 20 to prevent the pair of arms 36*c* from contacting the roller portion of the heating roller 20. Accordingly, damage and wear of the roller portion of the heating roller 20 due to the pair of arms 36*c* in contact with the roller portion of the heating roller 20 are prevented, and image noise does not generate.

Image noise may generate due to damage and wear of the roller portion of the heating roller 20 within the passage width Wp of the recording sheet P. To address this problem, the arms 36*c* are provided at least outboard of the passage width Wp of the recording sheet P. The whole aim 36*c* may not be provided outboard of the passage width Wp of the recording sheet P. For example, at least a portion opposing the heating roller 20, that is, the leading edge portion 36*a* of the guide 36F and a vicinity of the leading edge portion 36*a*, may be provided outboard of the passage width Wp of the recording sheet P.

As described above, in the fixing device 6E or 6F (depicted in FIG. 9 or 10A) including the guide 36 or 36F, respectively, the guide 36 or 36F causes the gloss application sheet S to contact the heating roller 20 at the position near the entry to the fixing nip N. By contrast, the fixing device 6, 6A, 6B, 6C, or 6D depicted in FIG. 4, 5, 6, 7, or 8, respectively, does not include the guide 36 or 36F. However, the sheet conveyance roller 25 may be positioned relatively to the heating roller 20 as follows to cause the gloss application sheet S to contact the heating roller 20 at the position near the entry to the fixing nip N.

Figure 12:
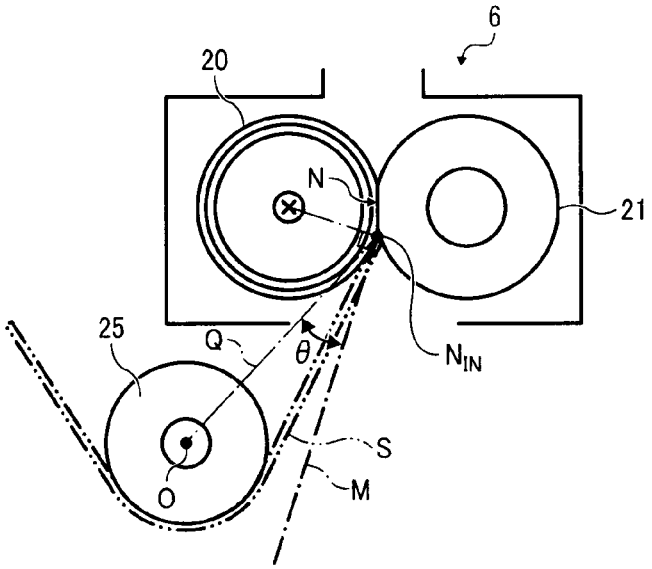
FIG. 12 is a sectional view of a heating roller, a pressing roller, and a sheet conveyance roller included in the fixing device shown in FIG. 4 for explaining a relative position of the sheet conveyance roller with respect to the heating roller.

FIG. 12 is a sectional view of the heating roller 20, the pressing roller 21, and the sheet conveyance roller 25 for explaining a relative position of the sheet conveyance roller 25 with respect to the heating roller 20. As illustrated in FIG. 12, the sheet conveyance roller 25 is provided on the left of a tangent line M of the heating roller 20 passing through an entry edge $N_{IN}$ of the fixing nip N formed between the heating roller 20 and the pressing roller 21. In other words, when the tangent line M and the heating roller 20 define a first compartment in an interior of the fixing device 6 and the tangent line M and the pressing roller 21 define a second compartment in the interior of the fixing device 6 opposite to the first compartment, the sheet conveyance roller 25 is provided in the first compartment.

When the sheet conveyance roller 25 is provided as described above to apply the tension F to the gloss application sheet S, the gloss application sheet S illustrated in a chain double-dashed line is provided in the first compartment defined by the tangent line M and the heating roller 20. Accordingly, the gloss application sheet S contacts the heating roller 20 at the position near the entry to the fixing nip N. Consequently, the heating roller 20 starts heating the gloss application sheet S at an earlier time, and supplies heat to the gloss application sheet S for a longer time. Thus, the heating roller 20 heats the gloss application sheet S effectively with less thermal energy. The greater an angle θ formed by the tangent line M with a straight line Q connecting a center O of the sheet conveyance roller 25 to the entry edge $N_{IN}$ of the fixing nip N, the farther the gloss application sheet S is separated from the tangent line M. Thus, the gloss application sheet S contacts the heating roller 20 at a larger area. When the sheet conveyance roller 25 is positioned relatively to the heating roller 20 as illustrated in FIG. 12, the guide 36 or 36F depicted in FIG. 9 or 10A, respectively, may be omitted. By contrast, with the guide 36 or 36F, the gloss application sheet S contacts the heating roller 20 at the position near the entry to the fixing nip N regardless of the relative position of the sheet conveyance roller 25 with respect to the heating roller 20.

In the fixing device 6, 6A, 6B, 6C, 6D, 6E, or 6F depicted in FIG. 4, 5, 6, 7, 8, 9, or 10A, respectively, a heating member (e.g., the heating roller 20 depicted in FIGS. 4 to 10A) contacts an opposing member (e.g., the pressing roller 21 depicted in FIGS. 4 to 10A) to form a fixing nip (e.g., the fixing nip N depicted in FIGS. 4 to 10A) between the heating member and the opposing member. A driver (e.g., the driver 6M depicted in FIG. 3) rotatively drives at least one of the heating member and the opposing member. A sheet supplier (e.g., the sheet supplier 11 depicted in FIGS. 4 to 10A) supplies and conveys a sheet (e.g., a gloss application sheet S depicted in FIGS. 4 to 10A) to the fixing nip. A recording medium (e.g., a recording sheet P) bearing an unfixed toner image (e.g., an unfixed toner image T) is conveyed through a gap between the sheet and the opposing member at the fixing nip with a side of the recording medium bearing the unfixed toner image facing the sheet. The heating roller heats the unfixed toner image on the recording medium via the sheet to fix the unfixed toner image on the recording medium. At least one of the rotating heating member and the rotating opposing member applies a driving force to the sheet supplied to the fixing nip while the sheet contacts the sheet supplier to apply tension to the sheet at a position upstream from the fixing nip in a sheet conveyance direction.

The tension is applied to the sheet at the position upstream from the fixing nip in the sheet conveyance direction to prevent the sheet from separating from a surface of the heating member at a position near an entry to the fixing nip. Accordingly, before the recording medium bearing the unfixed toner image enters the fixing nip, the unfixed toner image on the recording medium does not contact the sheet, preventing deterioration of the toner image.

The sheet supplier includes a rotating member (e.g., the sheet conveyance roller 25 depicted in FIGS. 4 to 10A) driven and rotated by a driving source (e.g., the motor 27 depicted in FIGS. 4 to 10A) to convey the sheet. When the sheet passes through the fixing nip while contacting the rotating member, a controller (e.g., the controller 28 depicted in FIGS. 4, 7, and 8) controls a circumferential velocity V1 of the rotating member to be smaller than a circumferential velocity V2 of at least one of the heating member and the opposing member.

Accordingly, a pulling force applied to the sheet by rotation of at least one of the heating member and the opposing member is greater than a pushing force applied to the sheet by rotation of the rotating member. Consequently, tension is applied to the sheet at the position upstream from the fixing nip in the sheet conveyance direction. As a result, the sheet does not separate from the surface of the heating member at the position near the entry to the fixing nip.

After the sheet reaches the fixing nip, the controller decreases a rotation velocity of the rotating member to cause the circumferential velocity V1 of the rotating member to be smaller than the circumferential velocity V2 of at least one of the heating member and the opposing member.

Before the controller decreases the circumferential velocity V1 of the rotating member, the rotating member rotates at the circumferential velocity V1 greater than the circumferential velocity V2 of at least one of the heating member and the opposing member. Accordingly, in a control condition in which the circumferential velocity V1 is decreased to be smaller than the circumferential velocity V2 while the sheet is conveyed toward the fixing nip, the rotating member feeds the sheet to the fixing nip faster compared to a control condition in which the circumferential velocity V1 is controlled to be smaller than the circumferential velocity V2 constantly.

After the sheet reaches the fixing nip, the controller may control output of the driving source to cause the circumferential velocity V1 of the rotating member to be smaller than the circumferential velocity V2 of at least one of the heating member and the opposing member.

The control of output of the driving source 27 decreases the rotation velocity of the rotating member to cause the circumferential velocity V1 of the rotating member to be smaller than the circumferential velocity V2 of at least one of the heating member and the opposing member.

The fixing device may further include a brake (e.g., the brake 29 depicted in FIG. 5) which applies a braking force to the rotating member after the sheet reaches the fixing nip, so as to cause the circumferential velocity V1 of the rotating member to be smaller than the circumferential velocity V2 of at least one of the heating member and the opposing member.

Accordingly, the brake decreases the rotation velocity of the rotating member to cause the circumferential velocity V1 of the rotating member to be smaller than the circumferential velocity V2 of at least one of the heating member and the opposing member.

The fixing device may further include a sheet detector (e.g., the non-contact sensor 33 depicted in FIG. 6) which detects the sheet that passes through the fixing nip. The controller decreases the rotation velocity of the rotating member based on a detection signal provided by the sheet detector to cause the circumferential velocity V1 of the rotating member to be smaller than the circumferential velocity V2 of at least one of the heating member and the opposing member.

The sheet detector detects that the sheet has reached the fixing nip precisely. Accordingly, the controller decreases the rotation velocity of the rotating member at a proper time to apply tension to the sheet, preventing the unfixed toner image on the recording medium from contacting the sheet precisely.

The fixing device may further include a torque limiter (e.g., the torque limiter 34 depicted in FIG. 7) which allows idling of the rotating member when tension applied to the sheet exceeds a predetermined threshold value.

Accordingly, the sheet nipped by the heating member and the opposing member is not pulled by the rotating member with an excessive force, and therefore excessive tension is not applied to the sheet. Consequently, the sheet is not damaged, and durability of the rotating member, the heating member, and the opposing member is maintained.

The fixing device may further include a tension detector (e.g., the tension measurement device 35 depicted in FIG. 8) which detects tension applied to the sheet. The controller controls output of the driving source based on a detection signal provided by the tension detector to apply a predetermined tension to the sheet.

Accordingly, excessive tension is not applied to the sheet. Consequently, the sheet is not damaged, and durability of the rotating member, the heating member, and the opposing member is maintained. Further, the predetermined tension may be changed to an arbitrary value. Accordingly, maximum tension applied to the sheet may be set based on strength of the sheet.

The sheet supplier is positioned relatively to the heating member to cause the sheet to contact the heating member at least at the position near the entry to the fixing nip when tension is applied to the sheet.

Accordingly, the heating member starts heating the sheet at an earlier time, and supplies heat to the sheet for a longer time. Consequently, the fixing device heats the sheet effectively with smaller thermal energy, thus saving energy and reducing manufacturing costs.

The fixing device may further include a guide member (e.g., the guide 36 depicted in FIG. 9) opposing the heating member at least at a position near the entry to the fixing nip to guide the sheet to the fixing nip in such a manner that the sheet contacts the heating member.

The guide member causes the sheet to contact the heating member at least at the position near the entry to the fixing nip. Accordingly, the heating member starts heating the sheet at an earlier time, and supplies heat to the sheet for a longer time. Consequently, the fixing device heats the sheet effectively with smaller thermal energy, thus saving energy and reducing manufacturing costs. Further, the guide member causes the sheet to contact the heating member at the position near the entry to the fixing nip regardless of a relative position of the sheet supplier with respect to the heating member.

At least an opposing portion (e.g., the leading edge portion 36*a* depicted in FIG. 10A) of the guide member which opposes the heating member may move closer to and away from the heating member. A biasing member (e.g., the tension spring 37A, the compression spring 37B, or the magnetic body 37C and the magnet 37D depicted in FIG. 10A, 10B, or 10C, respectively) applies a biasing force to the guide member to move the opposing portion of the guide member closer to the heating member.

Accordingly, a gap between the opposing portion of the guide member and the heating member may be changed according to thickness of the sheet. Consequently, even when sheets of various thicknesses are sent to the fixing device, the guide member guides the sheets to the fixing nip stably and smoothly so that the sheet contacts the heating member precisely.

At least the opposing portion of the guide member is provided outboard of a maximum width of the recording medium passing over the heating member.

When the heating member is damaged or worn within the maximum width of the recording medium passing over the heating member, the damaged or worn heating member may adversely affect a fixing process, and may form a faulty image such as an image having image noise. To address this problem, at least the opposing portion of the guide member is provided outboard of the maximum width of the recording medium passing over the heating member. Accordingly, the guide member does not contact a fixing region on the heating member which applies heat to the recording medium and therefore may not adversely affect the fixing region on the heating member. Consequently, the heating member may not be damaged or worn in the fixing region, preventing formation of a faulty image such as an image having image noise.

The sheet supplier supplies sheets one by one to correspond to recording media.

Accordingly, the sheet supplier does not include drums needed to supply a long sheet to the fixing nip continuously, that is, a supply reel drum around which the long sheet is wound and a take-up reel drum for taking up the long sheet sent from the supply reel drum. In other words, the sheet supplier for supplying sheets one by one to the fixing nip provides a compact fixing device.

A sheet is selectively supplied to the fixing nip to correspond to a recording medium.

Accordingly, when a toner image is fixed on a recording medium without applying gloss, a sheet is not supplied to the fixing nip. In other words, only the recording medium is supplied to the fixing nip for fixing the toner image on the recording medium. Consequently, usage of sheets is minimized.

According to the above-described exemplary embodiments, when the recording medium enters the fixing nip, the unfixed toner image on the recording medium does not contact the sheet, preventing the sheet from damaging the unfixed toner image on the recording medium to provide a high-quality image. Further, the toner image is fixed on the recording medium and is applied with gloss in a single fixing process, not in two processes, that is, a first, fixing process for fixing the toner image on the recording medium and a second, gloss-application process for applying gloss to the toner image on the recording medium, resulting in a shortened fixing process and a compact fixing device.

A driving force generated by rotation of at least one of the heating member and the opposing member to fix the toner image on the recording medium while conveying the recording medium and a driving force generated by rotation of the rotating member to feed the sheet to the fixing nip serve as a tension applicator for applying tension to the sheet. Accordingly, a mechanism for applying tension to the sheet, which is separately provided from the heating member, the opposing member, and the rotating member, is not needed, resulting in the compact fixing device.

According to the above-described exemplary embodiments, the driver (e.g., the driver 6M depicted in FIG. 3) is connected to the heating member. Alternatively, the driver may be connected to the opposing member or to both the heating member and the opposing member.

According to the above-described exemplary embodiments, the sheet supplier feeds sheets toward the fixing nip one by one. Alternatively, the sheet supplier may feed a long sheet (e.g., roll paper) toward the fixing nip continuously. However, a supply reel drum around which the long sheet is wound, which supplies the long sheet to the fixing nip, and a take-up reel drum for taking up the long sheet sent from the fixing nip are needed. Therefore, the sheet supplier, which feeds sheets toward the fixing nip one by one, may be downsized more easily. Further, the rotating member may be a rotary member having a belt shape instead of a roller shape.

According to the above-described exemplary embodiments, the fixing device 6, 6A, 6B, 6C, 6D, 6E, or 6F depicted in FIG. 4, 5, 6, 7, 8, 9, or 10A, respectively, includes the sheet supplier 11. Alternatively, the sheet supplier 11 may be provided separately from the fixing device 6, 6A, 6B, 6C, 6D, 6E, or 6F.

The image forming apparatus H depicted in FIG. 3 employs a tandem intermediate transfer method for transferring toner images formed on the plurality of photoconductors 2 onto a recording sheet P via the intermediate transfer belt 16. Alternatively, the image forming apparatus H may employ other image forming method.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device for fixing an unfixed toner image on a recording medium, comprising:

a heating member to apply heat to the unfixed toner image on the recording medium;

an opposing member to contact the heating member to form a fixing nip between the heating member and the opposing member;

a driver connected to at least one of the heating member and the opposing member to rotatively drive at least one of the heating member and the opposing member; and a sheet supplier provided upstream from the fixing nip in a sheet conveyance direction to supply and convey a sheet to the fixing nip, the recording medium bearing the unfixed toner image being conveyed through a gap between the sheet and the opposing member at the fixing nip with a side of the recording medium bearing the unfixed toner image facing the sheet, at least one of the rotating heating member and the rotating opposing member applying a driving force to the sheet supplied to the fixing nip while the sheet contacts the sheet supplier to apply tension to the sheet at a position upstream from the fixing nip in the sheet conveyance direction.

2. The fixing device according to claim 1, wherein the sheet supplier comprises:

a rotating member to convey the sheet toward the fixing nip;

a driving source connected to the rotating member to rotatively drive the rotating member; and a controller connected to the driving source to control output of the driving source, the controller controlling a circumferential velocity V1 of the rotating member to cause the circumferential velocity V1 of the rotating member to be smaller than a circumferential velocity V2 of at least one of the heating member and the opposing member.

3. The fixing device according to claim 2, wherein the controller controls the circumferential velocity V1 of the rotating member by decreasing a rotation velocity of the rotating member after the controller detects that the sheet reaches the fixing nip.

4. The fixing device according to claim 3, wherein the controller decreases the rotation velocity of the rotating member by decreasing output of the driving source connected to the rotating member.

5. The fixing device according to claim 3, further comprising a brake connected to the rotating member to apply a braking force to the rotating member, wherein the controller decreases the rotation velocity of the rotating member by contacting the brake to the rotating member.

6. The fixing device according to claim 3, further comprising a sheet detector provided downstream from the fixing nip in the sheet conveyance direction to detect passage of the sheet through the fixing nip, wherein the controller decreases the rotation velocity of the rotating member based on a detection signal provided by the sheet detector.

7. The fixing device according to claim 2, further comprising a torque limiter connected to the rotating member to allow idling of the rotating member when tension applied to the sheet by at least one of the heating member and the opposing member exceeds a predetermined threshold value.

8. The fixing device according to claim 2, further comprising a tension detector to contact the sheet to detect tension applied to the sheet by at least one of the heating member and the opposing member, wherein the controller controls output of the driving source based on a detection signal provided by the tension detector to apply predetermined tension to the sheet.

9. The fixing device according to claim 1, wherein a tangent line of the heating member passing through an entry edge of the fixing nip and the heating member define a first compartment in an interior of the fixing device and the tangent line and the opposing member define a second compartment in the interior of the fixing device opposite the first compartment, and the rotating member is provided in the first compartment to cause the sheet to contact the heating member at least near an entry to the fixing nip when tension is applied to the sheet by at least one of the heating member and the opposing member.

10. The fixing device according to claim 1, further comprising a guide member opposing the heating member at least near an entry to the fixing nip to guide the sheet to the fixing nip and contact the sheet against the heating member.

11. The fixing device according to claim 10, further comprising a biasing member connected to the guide member to apply a biasing force to the guide member to move at least an opposing portion of the guide member disposed opposite the heating member toward the heating member.

12. The fixing device according to claim 11, wherein at least the opposing portion of the guide member disposed opposite the heating member is provided outboard of a maximum width of accommodatable recording media that the fixing device is capable of accommodating as the recording medium passes over the heating member.

13. The fixing device according to claim 1, wherein the sheet supplier successively supplies individual sheets to the fixing nip automatically, each individual sheet thus supplied to the fixing nip corresponding to a one of the recording media conveyed to the fixing nip.

14. The fixing device according to claim 1, wherein the sheet supplier successively supplies individual sheets to the fixing nip selectively, each individual sheet thus supplied to the fixing nip corresponding to a one of the recording media conveyed to the fixing nip.

15. An image forming apparatus comprising the fixing device according to claim 1.

16. An image forming method for an image forming apparatus having a fixing device for fixing an unfixed toner image on a recording medium, the image forming method comprising the steps of:

rotating a rotating member provided upstream from a fixing nip formed between a heating member and an opposing member to convey a sheet to the fixing nip in a sheet conveyance direction;

rotating the heating member and the opposing member to convey the sheet sent from the rotating member;

applying, using at least one of the rotating heating member and the rotating opposing member, a driving force to the sheet supplied to the fixing nip while the sheet contacts the rotating member to apply tension to the sheet at a position upstream from the fixing nip in the sheet conveyance direction; and conveying the recording medium bearing the unfixed toner image through a gap between the sheet and the opposing member at the fixing nip with a side of the recording medium bearing the unfixed toner image facing the sheet.

* * * * *